US010731651B2

(12) United States Patent
Patil et al.

(10) Patent No.: US 10,731,651 B2
(45) Date of Patent: Aug. 4, 2020

(54) APERTURES SPACED AROUND IMPELLER BOTTOM SHROUD OF CENTRIFUGAL PUMP

(71) Applicant: Baker Hughes Incorporated, Houston, TX (US)

(72) Inventors: Abhay Patil, College Station, TX (US); Mike A. Swatek, Claremore, OK (US); Risa Rutter, Claremore, OK (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 236 days.

(21) Appl. No.: 15/410,418

(22) Filed: Jan. 19, 2017

(65) Prior Publication Data

US 2017/0241424 A1 Aug. 24, 2017

Related U.S. Application Data

(60) Provisional application No. 62/298,654, filed on Feb. 23, 2016.

(51) Int. Cl.

| | |
|---|---|
| ***F04D 1/06*** | (2006.01) |
| ***F04D 13/10*** | (2006.01) |
| ***F04D 29/16*** | (2006.01) |
| ***F04D 29/22*** | (2006.01) |
| ***F04D 29/44*** | (2006.01) |

(52) U.S. Cl.

CPC ..... *F04D 1/06* (2013.01); *F04D 13/10* (2013.01); *F04D 29/167* (2013.01); *F04D 29/2266* (2013.01); *F04D 29/448* (2013.01)

(58) Field of Classification Search

CPC ..... F04D 1/06; F04D 13/10; F04D 29/167; F04D 29/2266; F04D 29/448; F04D 13/08; F04D 13/06; F04D 29/44; F04D 29/40; F04D 29/0413; F04D 29/041; F04D 7/045; F04D 29/669; F04D 29/2277; F04D 29/445; F04D 29/426; F04D 29/026; F04D 29/2294

USPC ..... 415/149.4, 168.1, 182.1

See application file for complete search history.

(56) References Cited

U.S. PATENT DOCUMENTS

| | | | | |
|---|---|---|---|---|
| 1,839,514 A * | 1/1932 | Weis | F04D 29/167 415/144 |
| 1,974,107 A | 9/1934 | Hait | |
| 2,066,505 A | 8/1935 | Wolfe | |
| 2,145,598 A | 6/1937 | Hait | |
| 2,759,945 A | 8/1956 | Anderson | |
| 3,316,849 A * | 5/1967 | Humphrey | F04D 9/041 417/202 |

(Continued)

FOREIGN PATENT DOCUMENTS

DE 10112018 A1 9/2002

*Primary Examiner* — Nathaniel E Wiehe
*Assistant Examiner* — Emily S Adelman
(74) *Attorney, Agent, or Firm* — Bracewell LLP; James E. Bradley

(57) ABSTRACT

A submersible well pump assembly includes a pump driven by a motor. The pump has a number of stages, each stage including a diffuser having an annular diffuser inlet with an annular outer wall. Diffuser passages lead downstream and inward from the diffuser inlet. An impeller has a circumferential outer edge adjacent the outer wall of the diffuser inlet. Notches are formed in the circumferential outer edge, defining a serrated configuration.

20 Claims, 3 Drawing Sheets

(56) References Cited

U.S. PATENT DOCUMENTS

| | | | | |
|---|---|---|---|---|
| 4,642,023 | A | 2/1987 | Dunn | |
| 4,720,239 | A | 1/1988 | Owczarek | |
| 6,220,819 | B1 | 4/2001 | Chien et al. | |
| 7,775,763 | B1 | 8/2010 | Johnson et al. | |
| 9,046,090 | B2 | 6/2015 | Kao et al. | |
| 2006/0060721 | A1 | 3/2006 | Watts et al. | |
| 2010/0135765 | A1* | 6/2010 | Burgess | F04D 7/04 415/1 |
| 2011/0058928 | A1 | 3/2011 | Sheth et al. | |
| 2015/0292519 | A1* | 10/2015 | Stark | F04D 7/04 415/126 |
| 2015/0354590 | A1* | 12/2015 | Kao | F04D 29/448 415/199.3 |

* cited by examiner

APERTURES SPACED AROUND IMPELLER BOTTOM SHROUD OF CENTRIFUGAL PUMP

CROSS REFERENCE TO RELATED APPLICATION

This application claims priority to provisional application Ser. No. 62/298,654, filed Feb. 23, 2016.

FIELD OF THE DISCLOSURE

This disclosure relates in general to electrical submersible well pumps and in particular to a centrifugal pump having impeller and diffuser stages, each of the impellers having apertures formed in and spaced around the circumference of a bottom shroud of the impeller.

BACKGROUND

Electrical submersible well pumps ("ESP") are commonly used to produce well fluid from hydrocarbon producing wells. A conventional ESP has a pump operatively coupled to an electrical motor for driving the pump. A pressure equalizer or seal section is normally located between the motor and the pump. One common type of pump is a centrifugal pump.

A centrifugal well pump has a large number of stages, each stage having a rotating impeller and a non rotating diffuser. The impeller has a tubular hub through which the pump shaft extends. Impeller vanes extend outward from a central intake area. Top and bottom shrouds are mounted to upper and lower edges of the vanes to define impeller passages. The impeller has a downward extending cylindrical skirt that engages in a sliding fit with a skirt guide on an upper side of the diffuser immediately below. As the shaft rotates the impellers, the well fluid discharged upward creates a down thrust on each impeller, the down thrust being absorbed by a thrust washer between the bottom shroud and the diffuser immediately below.

Some wells produce considerable quantities of abrasive particles such as sand. The abrasive particles cause wear on various surfaces of the impellers and diffusers. One place of wear occurs on the skirt, creating an annular clearance between the skirt seal area and the mating surface on the next lower diffuser. The increasing annular clearance increases leakage and reduces the differential pressure across the skirt seal area. With a lower pressure differential, the pressure acting upward on the bottom shroud reduces, increasing the down thrust of the impeller. The increased down thrust can lead to production loss.

SUMMARY

A submersible well pump assembly includes a pump and a motor operatively coupled to the pump for driving the pump. The pump has a large number of stages, each stage having a rotatable impeller and a nonrotating diffuser. Each impeller has a plurality of vanes extending from a central inlet area of the impeller to a periphery of the impeller. A top shroud overlies and joins to upper edges of the vanes. A bottom shroud abuts and joins lower edges of the vanes. A plurality of apertures are formed in the bottom shroud outside of the central inlet area.

A down thrust washer is between a lower side of the bottom shroud and the diffuser directly below. The apertures are located outward from the down thrust washer. The apertures may be radially farther from the axis than the top shroud circumference.

Each of the apertures has a circumferential width. A circumference distance between each of the apertures is greater than the circumferential width.

The apertures may comprise notches formed in a circumference of the bottom shroud, the notches being circumferentially spaced apart from each other. Notches define a serrated edge at the circumference of the bottom shroud. Spaces in the circumference between each of the notches have circumferential lengths at least equal to a circumferential dimension of each of the notches.

In the embodiment shown, each of the notches has a curved outward facing base. Each of the notches may have a circumferential dimension greater than a radial depth.

The diffuser has an annular diffuser inlet and a plurality of diffuser passages extending inward and upward from the diffuser inlet. The diffuser inlet has an annular outer wall portion located radially outward from the circumference of the bottom shroud. A radial clearance between the circumference of the bottom shroud and the outer wall portion oscillates between a smaller dimension and a larger dimension as the notches rotate past the outer wall portion.

DETAILED DESCRIPTION OF THE DISCLOSURE

Figure 1:
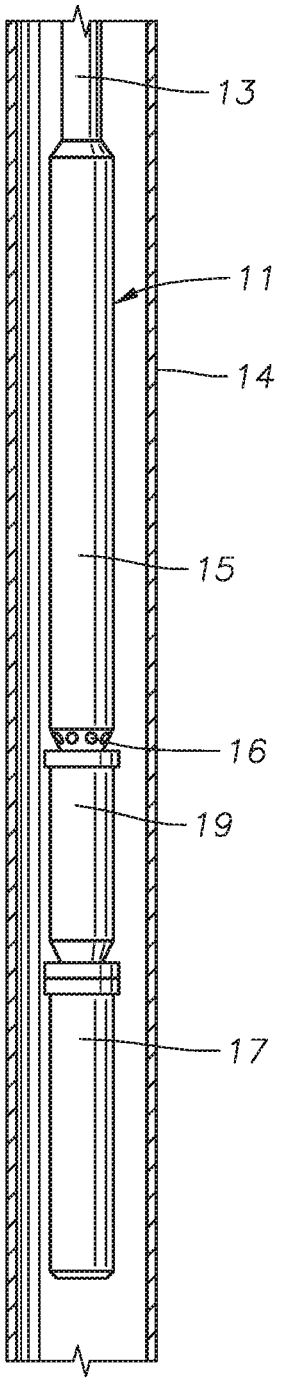
FIG. 1 is a side view of an electrical submersible well pump assembly having a pump in accordance with this disclosure.

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, a well has a submersible well pump assembly (ESP) 11 supported on a string of production tubing 13 suspended in casing 14. ESP 11 includes a pump 15 with an intake 16. A motor 17, which is typically a three-phase electrical motor, drives pump 15. An upper end of motor 17 connects to a seal section 19 that seals dielectric lubricant in motor 17. Also, seal section 19 may have a pressure equalizing element to equalize the pressure of the lubricant in motor 17 with the hydrostatic pressure of the well fluid on the exterior of motor 17.

Figure 2:
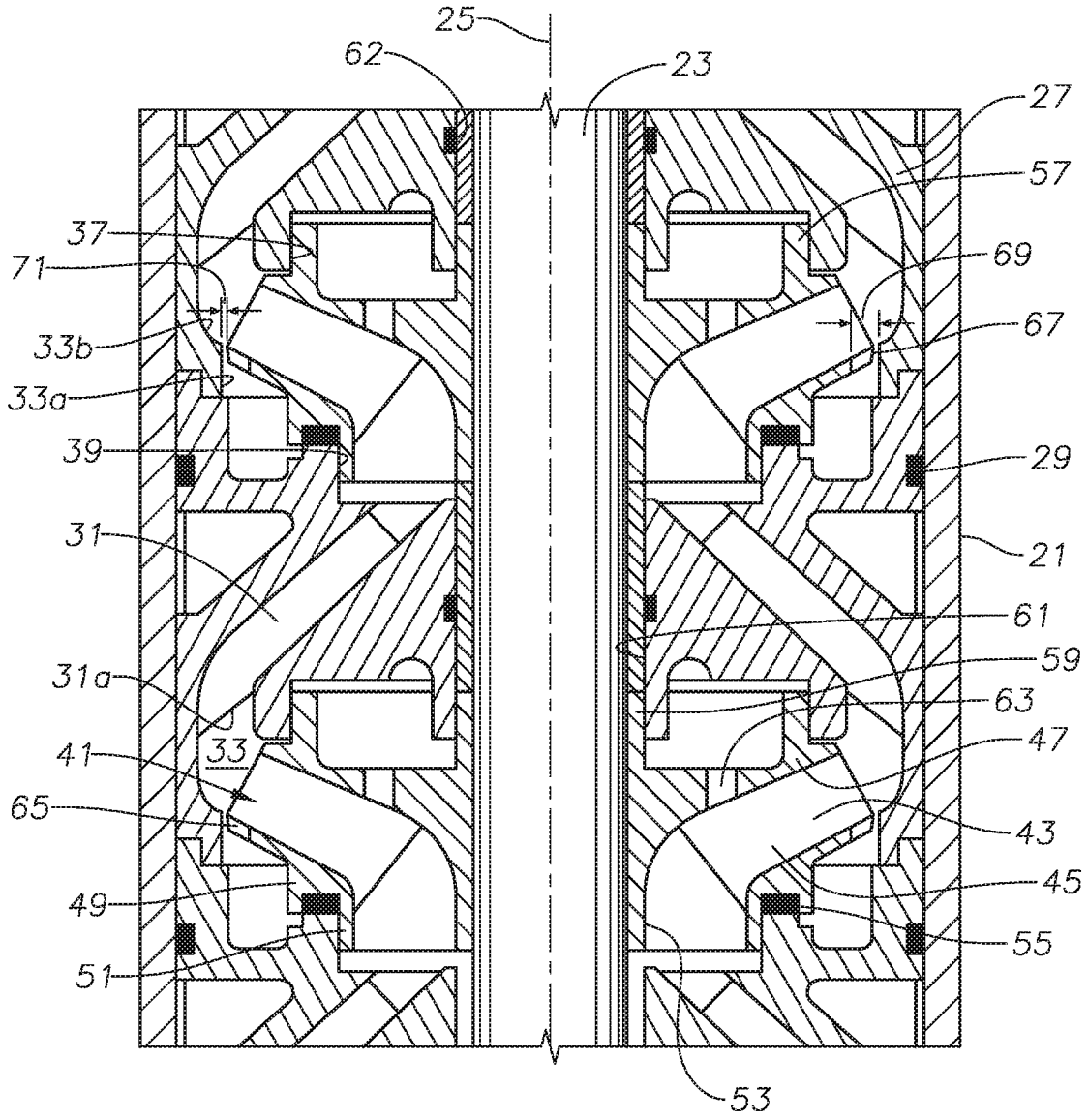
FIG. 2 is a sectional view of part of the pump of FIG. 1, illustrating two or the impellers, each having recesses in the circumference of the bottom shroud in accordance with this disclosure.

Referring to FIG. 2, pump 15 has a tubular housing 21 and a rotatable drive shaft 23 located on an axis 25 of housing 21. Pump 15 is a centrifugal type, having a large number of stages (only two shown). Each stage has a diffuser 27 that is fixed in a stack in housing 21 with other diffusers 27 so as to be non rotatable in housing 21. A seal 29 seals the outer diameter of each diffuser 27 to the inner surface of housing 21.

Each diffuser 27 has a plurality of diffuser passages 31 that extend upward and outward from a diffuser passage inlet 31*a*. The terms "upper", "upward", "lower", "downward" and the like are used only for convenience as pump 15 may operate horizontally as well as vertically. An annular, diffuser central inlet 33 joins all of the diffuser passage inlets 31*a*. In this example, diffuser central inlet 33 has a cylindrical outer wall portion 33*a* that joins the lower end of a curved outer wall portion 33*b* of larger inner diameter. The junction of cylindrical outer wall portion 33*a* with curved outer wall portion 33*b* creates a corner. Each diffuser 27 has a counterbore or cylindrical balance ring guide 37 on its lower side. Each diffuser 27 has a counterbore or cylindrical skirt guide 39 on its upper side.

Each stage of pump 15 has an impeller 41 that is secured to shaft 23, typically by a key and a slot, for rotation therewith. Each impeller 41 has a plurality of passages 43 that extend outward as well as curve away from the direction of rotation. If a mixed flow type, as shown, each impeller passage 43 also extends in an upward and outward direction. Impeller 41 has vanes 45 that define sides of each impeller passage 43. A top or downstream shroud 47 overlies and joins upper edges of all of the vanes 45. A bottom or upstream shroud 49 joins lower edges of all of the vanes 45. Top and bottom shrouds 47, 49 define upper and lower sides of each impeller passage 43.

Bottom shroud 49 has a skirt 51 with a cylindrical outer diameter that slides in rotational and sealing engagement with the skirt guide 39 of the next lower diffuser 27. Impeller 41 has an annular central impeller inlet 53 that joins all of impeller passages 43. A down thrust washer 55 locates between bottom shroud 49 and the next lower diffuser 27 for transferring down thrust from each impeller 41 to the next lower diffuser 27.

The top shroud 47 of each impeller 41 has a balance ring 57 on an upper side. Balance ring 57 has an outer diameter that slides in rotational and sealing engagement with the diffuser balance ring guide 37 of the next upper diffuser 27. Each impeller 41 has a hub 59 with a cylindrical bore that slides over shaft 23 and rotates with shaft 23. Hub 59 has an outer diameter that slides in rotational engagement with a diffuser bore 61 in the next upper diffuser 27. Spacer tubes 62 may mount between hubs 59 to transfer down thrust. Top shroud 47 may have balance holes 63, each extending down from the upper side of top shroud 47 to one of the impeller passages 43. Some of the well fluid discharge from impeller passages 43 leaks through the clearance between balance ring 57 and balance ring guide 37 to the upper side of top shroud 47. Balance holes 63 recirculate some of this well fluid through balance holes 63 back into impeller passages 43, reducing down thrust imposed on down thrust washer 55.

In a well laden with a high content of sand particles, wear can occur at the interface between impeller skirt 51 and skirt guide 39. The wear increases the clearance between impeller skirt 51 and skirt guide 39, causing leakage through the clearance to increase. The differential pressure at the seal between impeller skirt 51 and skirt guide 39 will drop, and the down thrust on down thrust washer 55 will increase. The result is a loss in production of the pump.

Figure 3:
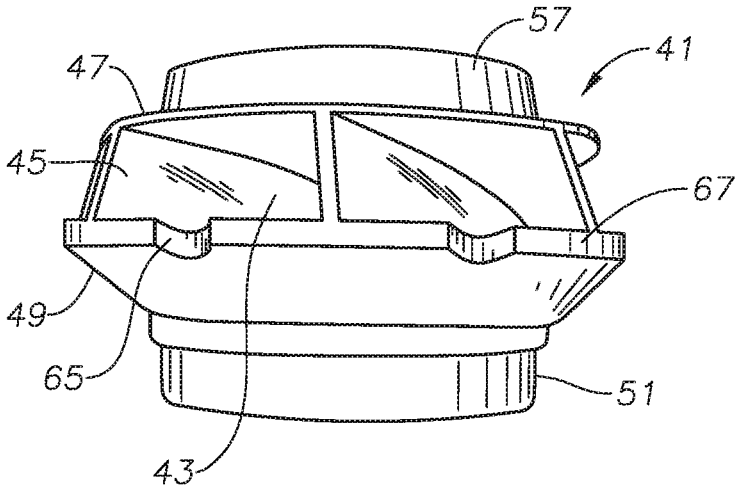
FIG. 3 is perspective view of one of the impellers of FIG. 2, shown removed from the pump.
Figure 4:
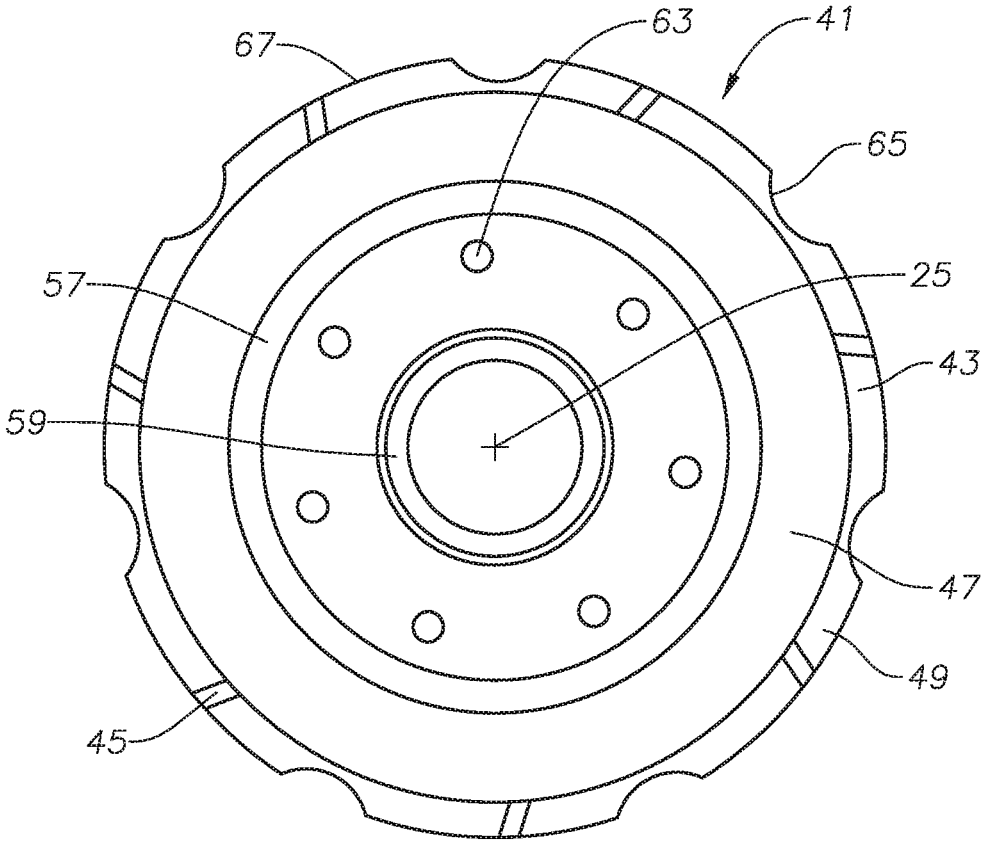
FIG. 4 is a top view of the impeller shown in FIG. 3.

In this disclosure, apertures are formed at the outer periphery of bottom shroud 49. The apertures may be grooves, scallops, recesses or notches 65 formed in the circumferential outer edge 67 of bottom shroud 49. Alternately, the apertures could be circular holes (not shown) formed outward from impeller inlet 53 and near but radially inward from outer edge 67. As shown in FIGS. 3 and 4, notches 65 are circumferentially and evenly spaced apart from each other around outer edge 67. The circumferential distance between adjacent notches 65 may be at least as much as the circumferential dimension of each notch 65 or it may be less. In this example, each notch 65 is centered with one of the impeller passages 43 between adjacent impeller vanes 45. The shape of notches 65 may differ, and in this example, each notch 65 is curved, providing a scalloped or serrated contour to outer edge 67. In this embodiment, the maximum radial depth of each notch 65 is at a center point of each notch 65 and is less than the circumferential dimension of notch 65 measured where it joins circumferential edge 67. The base forming each notch 65 may be radially farther than the circumferential outer edge of top shroud 47 as can be seen in the top view of FIG. 4.

Referring again to FIG. 2, a radial clearance 69 will exist between the maximum depth part of each notch 65 and the corner between diffuser inlet outer wall portions 33*a*, 33*b*. Clearance 69 is greater than a radial clearance 71 that exists between bottom shroud outer edge 67 between notches 65 and the corner between diffuser inlet outer wall portions 33*a*, 33*b*. As impeller 41 rotates, the clearance between bottom shroud 49 and diffuser inlet outer wall portions 33*a*, 33*b* thus oscillates between dimension 69 and dimension 71. Notches 65 reduce down thrust on down thrust washer 55. Notches 65 do not affect the hydraulic performance of the pump stage.

The present invention described herein, therefore, is well adapted to carry out the objects and attain the ends and advantages mentioned, as well as others inherent therein. While only a few embodiments of the invention have been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

The invention claimed is:

1. A submersible well pump assembly, comprising:

a pump having a longitudinal axis;

a motor operatively coupled to the pump for driving the pump;

a plurality of stages in the pump, each stage having a rotatable impeller and a nonrotating diffuser; each of the impellers comprising:

a plurality of vanes extending from a central inlet area of the impeller to a periphery of the impeller;

a top shroud overlying and joined to upper edges of the vanes;

a bottom shroud overlying and joined to lower edges of the vanes, the vanes, the top shroud, and the bottom shroud defining a plurality of impeller passages; and a plurality of apertures in the bottom shroud outward from the central inlet area, each of the apertures having an upper side within one of the impeller passages.

2. The submersible pump assembly according to claim 1, further comprising:

an annular diffuser inlet and a plurality of diffuser passages extending inward and upward from the diffuser inlet, the diffuser inlet having a cylindrical outer wall portion located radially outward from a circumference of the bottom shroud; and wherein the apertures are located in a peripheral portion of the bottom shroud that inclines upward relative to the outer wall portion of the diffuser inlet.

3. The submersible pump assembly according to claim 1, wherein:

each of the apertures has a circumferential dimension; and a circumference distance between each of the apertures is greater than the circumferential dimension.

4. The submersible pump assembly according to claim 1, wherein the apertures comprise notches formed in a circumference of the bottom shroud, the notches being circumferentially spaced apart from each other.

5. The submersible pump assembly according to claim 1, wherein:

the apertures comprise notches formed in a circumference of the bottom shroud, the notches being circumferentially spaced apart from each other, defining a serrated edge at the circumference of the bottom shroud; and spaces in the circumference between each of the notches have circumferential lengths at least equal to a circumferential dimension of each of the notches.

6. The submersible pump assembly according to claim 1, wherein:

the apertures comprise notches formed in a circumference of the bottom shroud, the notches being circumferentially spaced apart from each other; and each of the notches has a curved outward facing base.

7. The submersible pump assembly according to claim 1, wherein the apertures comprise notches formed in a circumference of the bottom shroud; and each of the notches is curved, faces outward, and has a circumferential dimension greater than a radial depth.

8. The submersible pump assembly according to claim 1, wherein each of the diffusers comprises:

an annular diffuser inlet and a plurality of diffuser passages extending inward and upward from the diffuser inlet, the diffuser inlet having an annular outer wall portion located radially outward from the circumference of the bottom shroud;

wherein the apertures comprise circumferentially spaced apart notches formed in the circumference of the bottom shroud; and a radial clearance between the circumference of the bottom shroud and the outer wall portion oscillates between a smaller dimension and a larger dimension as the notches rotate past the outer wall portion.

9. The submersible pump assembly according to claim 1, wherein:

each of the apertures has a lower side flush with a lower side of the bottom shroud and an upper side flush with an upper side of the bottom shroud, and wherein a line parallel to the longitudinal axis passes through each of the apertures from the lower side to the upper side of each of the apertures.

10. A submersible well pump assembly, comprising:

a pump having a longitudinal axis;

a motor operatively coupled to the pump for driving the pump;

a plurality of stages in the pump, each of the stages comprising:

a diffuser having an annular diffuser inlet with an annular outer wall and a plurality of diffuser passages leading downstream and inward from the diffuser inlet;

an impeller having a circumferential outer edge adjacent the outer wall of the diffuser inlet; and a plurality of notches formed in the circumferential outer edge, defining a serrated configuration.

11. The pump assembly according to claim 10, wherein the impeller further comprises:

a downstream shroud;

an upstream shroud;

a plurality of impeller passages between the downstream and the upstream shrouds and leading outward from an impeller inlet; and wherein the circumferential outer edge is located on the upstream shroud.

12. The pump assembly according to claim 10, wherein:

spaces in the circumference outer edge between each of the notches have circumferential lengths at least equal to a circumferential dimension of each of the notches.

13. The submersible pump assembly according to claim 10, wherein:

each of the notches has a curved outward facing base.

14. The submersible pump assembly according to claim 10, wherein each of the notches is curved, faces outward, and has a circumferential dimension greater than a radial depth.

15. The pump assembly according to claim 10, wherein:

a radial clearance between the circumferential outer edge and the outer wall portion oscillates between a smaller dimension and a larger dimension as the notches rotate past the outer wall portion.

16. A submersible well pump assembly, comprising:

a pump having a longitudinal axis;

a motor operatively coupled to the pump for driving the pump;

a plurality of stages in the pump, each of stages comprising:

a diffuser having an annular diffuser inlet with an annular outer wall and a plurality of diffuser passages leading downstream and inward from the diffuser inlet;

an impeller having a top shroud, a bottom shroud, and a plurality of vanes between the upper and bottom shrouds, the vanes extending upward and outward from a central inlet area of the impeller;

the bottom shroud having a circumferential outer edge adjacent the outer wall of the diffuser inlet; and a plurality of notches evenly spaced around the circumferential outer edge of the bottom shroud.

17. The pump assembly according to claim 16, wherein:

a radial clearance between the circumferential outer edge and the outer wall portion oscillates between a smaller dimension and a larger dimension as the notches rotate past the outer wall portion.

18. The pump assembly according to claim 16, wherein:

the circumferential outer edge of the bottom shroud has a greater diameter than an outer diameter of the top shroud; and each of the notches has center point located a radial distance from the axis that is greater than a radial distance from the axis to the outer diameter of the top shroud.

19. The submersible pump assembly according to claim 16, wherein:

each of the notches has a curved outward facing base.

20. The submersible pump assembly according to claim 16, wherein each of the notches is curved, faces outward, and has a circumferential dimension greater than a radial depth.

* * * * *